US009668520B2

(12) United States Patent
Boldrini

(10) Patent No.: US 9,668,520 B2
(45) Date of Patent: Jun. 6, 2017

(54) METHOD AND UNIT FOR FILLING A DISPOSABLE ELECTRONIC-CIGARETTE CARTRIDGE WITH A LIQUID SUBSTANCE

(71) Applicant: G.D SOCIETA' PER AZIONI, Bologna (IT)

(72) Inventor: Fulvio Boldrini, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 14/917,300

(22) PCT Filed: Sep. 18, 2014

(86) PCT No.: PCT/IB2014/064636
§ 371 (c)(1),
(2) Date: Mar. 8, 2016

(87) PCT Pub. No.: WO2015/040568
PCT Pub. Date: Mar. 26, 2015

(65) Prior Publication Data

US 2016/0213064 A1 Jul. 28, 2016

(30) Foreign Application Priority Data

Sep. 18, 2013 (IT) ..... BO2013A0504

(51) Int. Cl.
*B65B 3/04* (2006.01)
*A24F 47/00* (2006.01)
(Continued)

(52) U.S. Cl.
CPC ..... *A24F 47/008* (2013.01); *A24B 15/16* (2013.01); *B65B 3/06* (2013.01); *B65B 3/30* (2013.01);
(Continued)

(58) Field of Classification Search
CPC ..... A24F 47/008; B65B 3/30; B65B 3/305
See application file for complete search history.

(56) References Cited

U.S. PATENT DOCUMENTS 4,205,711 A 6/1980 Lullini et al.
4,325,418 A 4/1982 Henle
(Continued)

FOREIGN PATENT DOCUMENTS

DE 1007511 B 5/1957
WO WO-2013/060827 A1 5/2013
WO WO-2013/093763 A1 6/2013

OTHER PUBLICATIONS

International Search Report and Written Opinion, International Application No. PCT/IB2014/064636, mailed Nov. 20, 2014.
(Continued)

*Primary Examiner* — Jason K Niesz
(74) *Attorney, Agent, or Firm* — Marshall, Gerstein & Borun LLP

(57) ABSTRACT

A method and unit for filling a disposable electronic cigarette cartridge with a liquid substance; a conveyor feeds the disposable cartridge along a filling path; a coupling device fits the disposable cartridge with a metering chamber, which is placed on top of the disposable cartridge, is of sufficient volume to contain a full measure of the liquid substance, and has a bottom outlet conduit terminating inside the disposable cartridge; a feed device feeds the liquid substance into the metering chamber so that the liquid substance falls by gravity from the metering chamber, along the outlet conduit, into the disposable cartridge; and a removing device removes the metering chamber from the disposable cartridge once all the liquid substance has fallen by gravity from the metering chamber, along the outlet conduit, into the disposable cartridge.

12 Claims, 3 Drawing Sheets

(51) Int. Cl.

| | |
|---|---|
| ***A24B 15/16*** | (2006.01) |
| ***B65B 3/06*** | (2006.01) |
| ***B65B 3/30*** | (2006.01) |
| *B65B 39/14* | (2006.01) |
| *B65B 3/14* | (2006.01) |

(52) U.S. Cl.
CPC ..... *B65B 3/305* (2013.01); *B65B 3/14* (2013.01); *B65B 39/14* (2013.01)

(56) References Cited

U.S. PATENT DOCUMENTS

| | | | |
|---|---|---|---|
| 2009/0151717 | A1 | 6/2009 | Bowen et al. |
| 2010/0160376 | A1 | 6/2010 | Thompson |
| 2012/0167906 | A1 | 7/2012 | Gysland |
| 2012/0325228 | A1 | 12/2012 | Williams |

OTHER PUBLICATIONS

Office Action (with English translation), Chinese patent application No. 201480051174.9, dated Mar. 2, 2017.

METHOD AND UNIT FOR FILLING A DISPOSABLE ELECTRONIC-CIGARETTE CARTRIDGE WITH A LIQUID SUBSTANCE

CROSS-REFERENCE TO RELATED APPLICATIONS

This application is the U.S. National Phase of PCT Application No. PCT/IB2014/064636, filed Sep. 18, 2014, which claims the benefit of Italian Patent application No. B02013A000504, filed Sep. 18, 2013.

TECHNICAL FIELD

The present invention relates to a method and unit for filling a disposable electronic-cigarette cartridge with a liquid substance.

BACKGROUND ART

Disposable electronic-cigarette cartridges have recently been proposed containing a hygroscopic (e.g. cotton-wool) wad impregnated with a viscous liquid substance containing nicotine and possibly also aromas. In actual use, the electronic cigarette heats the disposable cartridge to slowly volatilize (vapourize) the viscous liquid substance impregnating the hygroscopic wad.

Disposable cartridges of this sort are manufactured by producing a disposable cartridge with an open top end; inserting a dry hygroscopic wad inside the disposable cartridge; filling the disposable cartridge with a calibrated amount of liquid substance; and then plugging the open top end of the disposable cartridge with a plug permeable to vapour (i.e. that keeps in the liquid substance, but lets out the vapours produced by heating the liquid substance).

The most critical stage in the manufacture of disposable cartridges is filling them with the liquid substance. This is an extremely time-consuming job, partly on account of the liquid substance fed into the disposable cartridge having to impregnate the hygroscopic wad (a relatively slow process), and partly on account of the viscous nature of the liquid substance itself (i.e. its high density, which slows down its movement). As a result, currently used disposable cartridge manufacturing methods are extremely slow (i.e. have a low output rate) on account of the time taken to fill the disposable cartridges with the liquid substance.

To speed up the filling process, it has been proposed to pressure-feed the liquid substance into the disposable cartridges, so as to 'force-fill' the cartridges. Pressure-feeding the liquid substance into the disposable cartridges, however, has several drawbacks. Firstly, the pressure of the liquid substance may deform the hygroscopic wad and/or the disposable cartridge itself; which deformation may be destructive and at the very least is almost always permanent, i.e. with no springback recovery once the cartridge is filled and the pressure removed. Secondly, when pressure-feeding the liquid substance into the disposable cartridges, it is almost impossible to prevent some of the liquid substance from leaking from the cartridge and so fouling both the cartridge and the filling unit.

DESCRIPTION OF THE INVENTION

It is an object of the present invention to provide a method and unit for filling a disposable electronic-cigarette cartridge with a liquid substance, which method and unit are designed to eliminate the above drawbacks while at the same time being cheap and easy to implement.

According to the present invention, there are provided a method and unit for filling a disposable electronic-cigarette cartridge with a liquid substance, as claimed in the accompanying Claims.

BRIEF DESCRIPTION OF THE DRAWINGS

A non-limiting embodiment of the present invention will be described by way of example with reference to the attached drawings, in which.

PREFERRED EMBODIMENTS OF THE INVENTION

Figure 1:
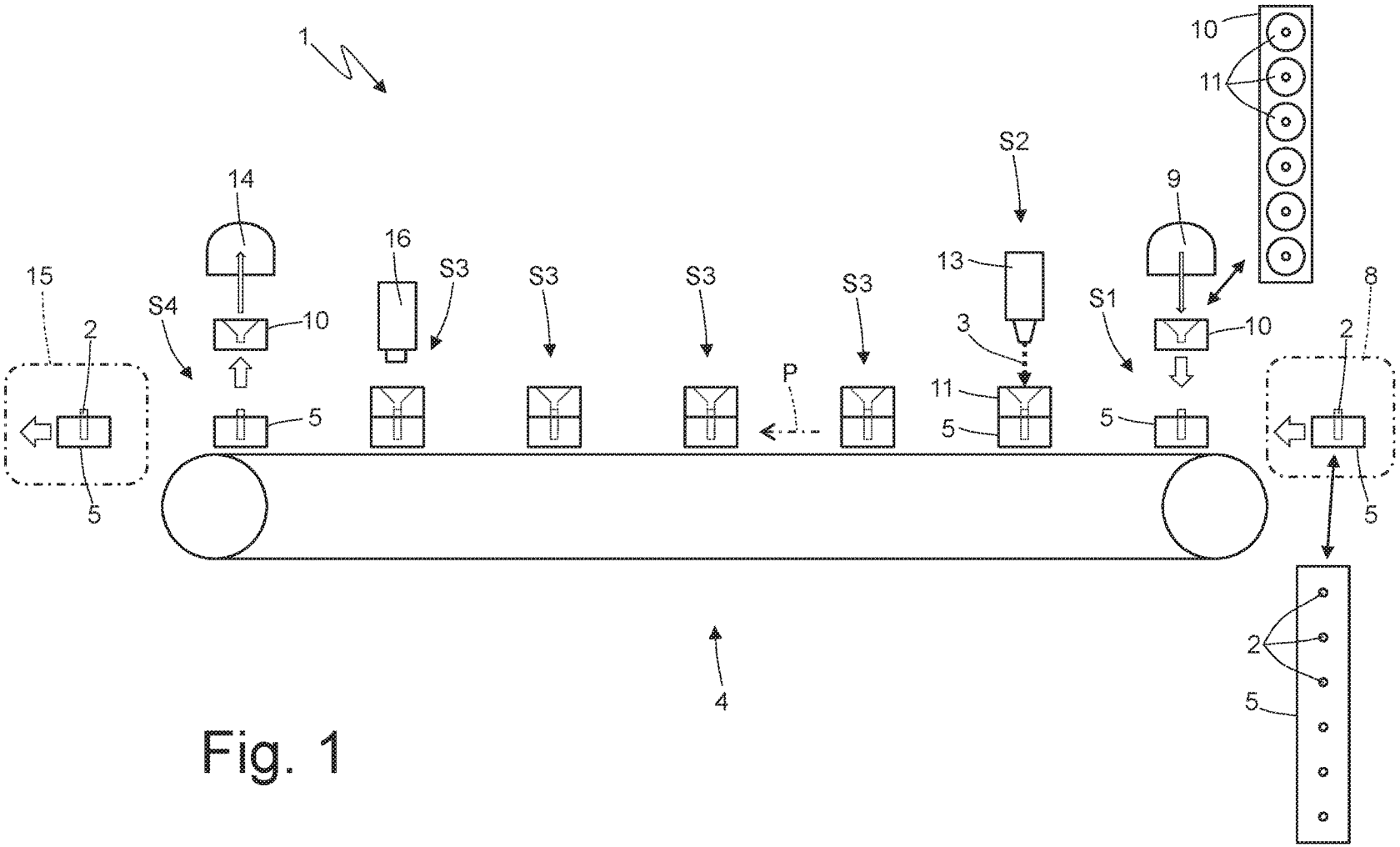
FIG. 1 shows a schematic, with parts removed for clarity, of a unit, in accordance with the present invention, for filling a disposable electronic-cigarette cartridge.

Number 1 in FIG. 1 indicates as a whole a unit for filling a disposable electronic-cigarette cartridge 2 with a viscous liquid substance 3 containing nicotine and possibly also aromas. By way of example, liquid substance 3 is glycol propylene, in which the nicotine and any aromas are dissolved.

Unit 1 comprises a conveyor 4, which feeds disposable cartridges 2 intermittently, i.e. in cyclically alternating stop-go steps, along a straight, horizontal filling path P. In the FIG. 1 embodiment, conveyor 4 is a belt conveyor comprising a flexible belt looped about two end pulleys at opposite ends of conveyor 4, and therefore at opposite ends of filling path P.

Upstream from conveyor 4, a group of disposable cartridges 2 is inserted inside a cartridge holder 5 having a number of cylindrical seats 6 (one of which is shown in cross section in FIG. 2), each for receiving and housing a respective disposable cartridge 2.

Conveyor 4 feeds along filling path P a succession of cartridge holders 5, each housing an orderly group of disposable cartridges 2 arranged in a row perpendicular to filling path P. The disposable cartridges 2 in each cartridge holder 5 are thus filled in parallel, i.e. simultaneously.

Figure 2:
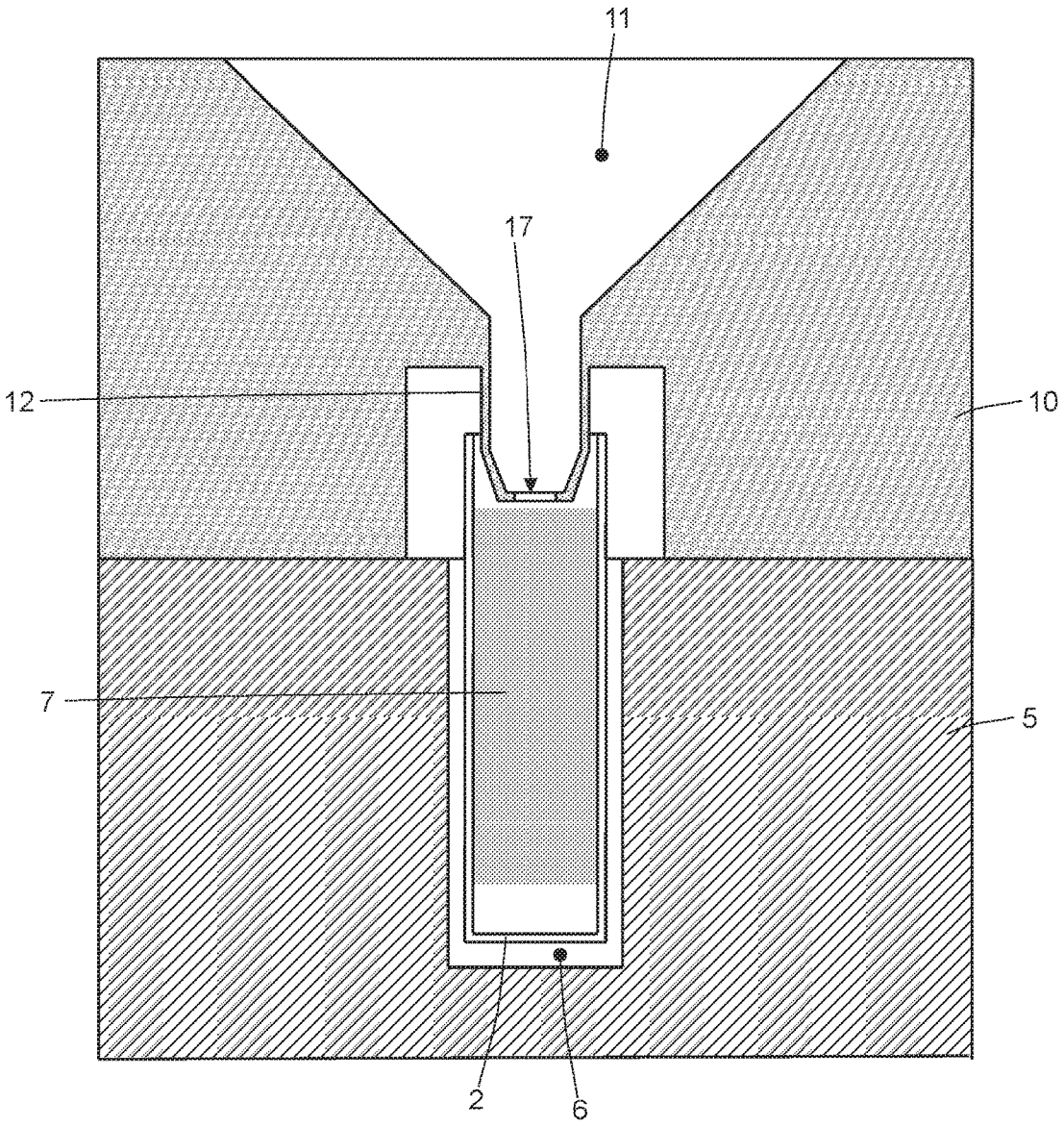
FIG. 2 shows a schematic of a metering chamber of the FIG. 1 unit.

As shown in FIG. 2, when fed onto conveyor 4, each disposable cartridge 2 has an open top end, through which liquid substance 3 is fed; and, inside, each disposable cartridge 2 has a hygroscopic (e.g. cotton-wool) wad 7 to be impregnated with liquid substance 3.

As shown in FIG. 1, upstream from conveyor 4, a loading device 8 loads cartridge holders 5, containing respective groups of disposable cartridges 2, cyclically onto conveyor 4. More specifically, loading device 8 loads cartridge holders 5, containing respective groups of disposable cartridges 2, cyclically onto the belt of conveyor 4, and preferably into respective pockets defined on conveyor 4 by known ribs (not shown) projecting from the belt.

At a coupling station S1 at the start of conveyor 4, i.e. at the start of filling path P, a coupling device 9 fits each cartridge holder 5 with a metering body 10. Normally, each metering body 10 is simply placed on top of cartridge holder 5. Preferably, metering body 10 and cartridge holder 5 have respective locators (e.g. truncated-cone-shaped pins projecting upwards from the top wall of cartridge holder 5, and which fit and centre automatically inside corresponding truncated-cone-shaped dead holes in the bottom wall of metering body 10) to accurately position metering body 10 and cartridge holder 5 with respect to each other. The locators also serve to maintain the correct relative position of each cartridge holder 5 and corresponding metering body 10, i.e. to prevent them from moving horizontally with respect to each other, as they are fed along filling path P.

Each metering body 10 has a number of metering chambers 11, each of which is positioned over a corresponding disposable cartridge 2, is of sufficient volume to contain a full measure of liquid substance 3 (i.e. the full amount of liquid substance 3 to be fed into disposable cartridge 2), and has a bottom outlet conduit 12 (FIG. 2) that terminates inside disposable cartridge 2. In other words, each metering body 10 has a number of metering chambers 11 arranged in a row perpendicular to filling path P, so as to match the arrangement of disposable cartridges 2 inside cartridge holders 5, so each disposable cartridge 2 inside a cartridge holder 5 corresponds to a metering chamber 11.

As shown in FIG. 2, each metering chamber 11 is funnel-shaped and, from its end portion, outlet conduit 12 extends vertically downwards into the open top end of a corresponding disposable cartridge 2. More specifically, one end of outlet conduit 12 of each metering chamber 11 is truncated-cone-shaped and tapers downwards, to enable outlet conduit 12 of each metering chamber 11 to centre automatically inside the open top end of corresponding disposable cartridge 2. The outside diameter of the truncated-cone-shaped end of outlet conduit 12 of each metering chamber 11 must be slightly smaller than the inside diameter of the open top end of corresponding disposable cartridge 2, so that outlet conduit 12 of each metering chamber 11 fits interferentially and in sufficiently fluidtight manner inside the open top end of corresponding disposable cartridge 2. A certain degree of fluidtightness between outlet conduit 12 of each metering chamber 11 and the open top end of corresponding disposable cartridge 2 is important to prevent the liquid substance 3 inside metering chamber 11 from leaking between outlet conduit 12 and the open top end and out of disposable cartridge 2, which is to be avoided at all cost.

As shown in FIG. 1, a feed station S2 downstream from coupling station S1 along filling path P houses a feed device 13 for feeding liquid substance 3 into each disposable cartridge 2 via corresponding metering chamber 11. In other words, at feed station S2, feed device 13 feeds liquid substance 3 into each metering chamber 11, so that liquid substance 3 falls by gravity from metering chamber 11, along outlet conduit 12, into disposable cartridge 2.

Downstream from feed station S2, a succession of hold stations S3 is located along filling path P; and cartridge holders 5, containing disposable cartridges 2 into which liquid substance 3 is flowing by gravity from metering chambers 11 above, are fed through hold stations S3 until all the liquid substance 3 has fallen by gravity from each metering chamber 11, along outlet conduit 12, into disposable cartridge 2 underneath.

At a removal station S4 at the end of, i.e. downstream from, the succession of hold stations S3 along filling path P, a removing device 14 removes metering body 10 from each cartridge holder 5 once all the liquid substance 3 has fallen by gravity from each metering chamber 11, along outlet conduit 12, into disposable cartridge 2 underneath.

As shown in FIG. 1, an unloading device 15 downstream from conveyor 4 unloads cartridge holders 5, containing respective groups of disposable cartridges 2 filled with liquid substance 3, cyclically off conveyor 4. More specifically, loading device 15 lifts cartridge holders 5, containing respective groups of disposable cartridges 2 filled with liquid substance 3, cyclically off the belt of conveyor 4. Downstream from unloading device 15, cartridge holders 5, containing respective groups of disposable cartridges 2 filled with liquid substance 3, are fed to a capping unit, where each disposable cartridge 2 is completed by capping its open top end.

The removed metering bodies 10 are transferred ('recycled') from removing device 14 to coupling device 9 for use again. Between removing device 14 and coupling device 9, a store may be provided in which to store metering bodies 10 pending further use. In one possible embodiment, as they are being transferred from removing device 14 to coupling device 9, the removed metering bodies 10 may undergo a wash cycle (e.g. be fed through a water-jet or pressurized-steam wash chamber). One function of the wash cycle is to prevent any liquid substance 3 dripping off the removed metering bodies 10 (i.e. from removal station S4) from fouling filling unit 1 and/or the empty disposable cartridges 2. Another is to provide clean metering bodies 10 that can be used indifferently in different filling processes employing different liquid substances 3.

In one possible embodiment shown in FIG. 1, filling unit 1 comprises an optical control device 16 located at the last hold station S3 (i.e. the hold station S3 adjacent to removal station S4) to optically check each metering chamber 11 upstream from removal station S4 contains no liquid substance 3, i.e. that all the liquid substance 3 has fallen by gravity from metering chamber 11, along outlet conduit 12, into disposable cartridge 2. Optical control device 16 normally comprises a television camera, which acquires digital images from above of metering chambers 11; and a lighting system, which illuminates metering chambers 11 to highlight the presence of liquid substance 3 (e.g. by exploiting the tendency of liquid substance 3 to reflect light). In the FIG. 1 embodiment, optical control device 16 is located at the last hold station S3; alternatively, optical control device 16 may be located between the last hold station S3 and removal station S4, or at removal station S4 itself.

In one possible embodiment not shown, filling unit comprises at least one blower located over metering bodies 10 at a hold station S3 or between two adjacent hold stations S3, and which directs a constant jet of compressed air downwards onto metering chambers 11 to force liquid substance 3 downwards (i.e. into disposable cartridge 2 underneath). The function of the compressed-air jet is to assist downflow of liquid substance 3 into disposable cartridge 2 underneath, and especially to accelerate downflow of the last drops of liquid substance 3 when metering chambers 11 are almost completely empty or when working with particularly viscous liquid substances 3.

Figure 3:
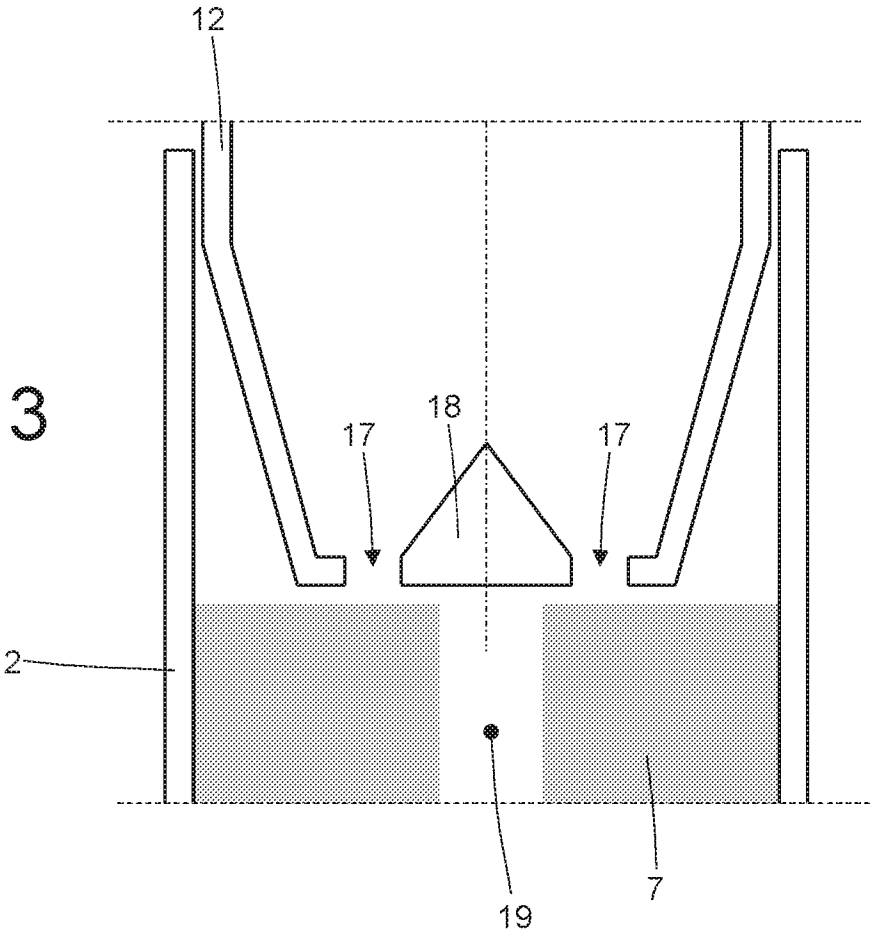
FIG. 3 shows a larger-scale view of an alternative embodiment of one end of an outlet conduit of the FIG. 2 metering chamber.

As shown in FIGS. 2 and 3, outlet conduit 12 of each metering chamber 11 terminates with an outlet opening 17, through which liquid substance 3 flows out of outlet conduit 12 and down into corresponding disposable cartridge 2. In the FIG. 2 embodiment, each outlet opening 17 is circular; in the alternative embodiment in FIG. 3, each outlet opening 17 is annular with a conical element 18 in the centre. The FIG. 3 embodiment with an annular outlet opening 17 is normally used when the hygroscopic wad 7 in each disposable cartridge 2 has a central hole (through or not) 19; in which case, the annular shape of outlet opening 17 causes liquid substance 3 to flow down solely into the solid part, as opposed to central hole 19, of hygroscopic wad 7.

Obviously, feed device 13 must feed each metering chamber 11 with slightly more than the amount of liquid substance 3 to be fed into disposable cartridge 2, since a small portion of liquid substance 3 (which may be minimized, for example, using the blowers) invariably clings to the inner walls of metering chamber 11 and outlet conduit 12, and so never reaches disposable cartridge 2. This problem is encountered, in particular, when working with viscous or high-surface-tension liquid substances 3.

Filling unit 1 described has numerous advantages.

Firstly, filling unit 1 provides for filling disposable cartridges 2 at a very high output rate, by virtue of the required amount of liquid substance 3 being fed rapidly into each metering chamber 11 at feed station S2, and the liquid substance 3 then having all the time it needs to fall by gravity from metering chamber 11, along outlet conduit 12, into disposable cartridge 2 underneath as disposable cartridge 2 is fed, inside corresponding cartridge holder 5 and together with other disposable cartridges 2, through hold stations S3. In other words, thanks to metering chambers 11, the step in which feed device 13 dispenses the required amount of liquid substance 3 is separated temporally from, and may therefore be performed much faster than, the step in which liquid substance 3 flows into disposable cartridges 2, which normally takes longer.

Secondly, in filling unit 1 described, liquid substance 3 flows into disposable cartridges 2 by gravity (i.e. at atmospheric pressure, with no overpressure applied), thus ensuring optimum filling of disposable cartridges 2 in terms of thorough impregnation of hygroscopic wads 7, preventing deformation of disposable cartridges 2 and/or hygroscopic wads 7, and preventing leakage of liquid substance 3 from disposable cartridges 2.

Finally, filling unit 1 described is also cheap and easy to implement by comprising structurally simple parts with few, easy to operate, movements.

The invention claimed is:

1. A method of filling a disposable electronic cigarette cartridge (2) with a liquid substance (3); the method comprising the steps of:

feeding the disposable cartridge (2) along a filling path (P) by means of a conveyor (4); and feeding the liquid substance (3) downwards into the disposable cartridge (2) at a feed station (S2) located along the filling path (P) and by means of a feed device (13);

the method being characterized by comprising the further steps of:

fitting the disposable cartridge (2), at a coupling station (S1) located along the filling path (P), upstream from the feed station (S2), with a metering chamber (11), which is placed on top of the disposable cartridge (2), is of sufficient volume to contain a full measure of the liquid substance (3), and has a bottom outlet conduit (12) terminating inside the disposable cartridge (2);

feeding the liquid substance (3) into the metering chamber (11) at the feed station (S2) and by means of the feed device (13), so that the liquid substance (3) falls by gravity from the metering chamber (11), along the outlet conduit (12), into the disposable cartridge (2);

waiting until all the liquid substance (3) has fallen by gravity from the metering chamber (11), along the outlet conduit (12), into the disposable cartridge (2); and removing the metering chamber (11) from the disposable cartridge (2), at a removal station (S4) located downstream from the feed station (S2) and by means of a removing device (14), once all the liquid substance (3) has fallen by gravity from the metering chamber (11), along the outlet conduit (12), into the disposable cartridge (2).

2. A method according to claim 1, wherein the metering chamber (11) is funnel-shaped.

3. A method according to Claim 1, comprising the further step of feeding the disposable cartridge, by means of the conveyor (4), through at least one hold station (S3) located between the feed station (S2) and the removal station (S4).

4. A method according to claim 1, comprising the further step of inserting the disposable cartridge (2) inside a cartridge holder (5) upstream from the conveyor (4), so as to feed the cartridge holder (5), containing the disposable cartridge (2), along the filling path (P).

5. A method according to claim 4, wherein the cartridge holder (5) has a number of seats (6) for housing a corresponding number of disposable cartridges (2), which are filled simultaneously, working in parallel.

6. A method according to claim 4, wherein the metering chamber (11) is positioned resting on the cartridge holder (5) at the coupling station (S1).

7. A method according to Claim 1, wherein one end of the outlet conduit (12) of the metering chamber (11) is truncated-cone-shaped, tapering downwards.

8. A method according to claim 7, wherein the end of the truncated-cone-shaped end of the outlet conduit (12) has an outside diameter substantially equal to the inside diameter of the open top end of the disposable cartridge (2).

9. A method according to claim 1, and comprising the further step, prior to removing the metering chamber (11), of optically controlling the metering chamber (11) to ensure it contains no liquid substance (3), i.e. that all the liquid substance (3) has fallen by gravity from the metering chamber (11), along the outlet conduit (12), into the disposable cartridge (2).

10. A method according to claim 1, wherein the outlet conduit (12) of the metering chamber (11) terminates with an annular outlet opening (17).

11. A method according to claim 10, wherein a conical element (18) is located in the centre of the annular outlet opening (17) of the outlet conduit (12) of the metering chamber (11).

12. A unit (1) for filling a disposable electronic cigarette cartridge (2) with a liquid substance (3); the unit (1) comprising:

a conveyor (4) for feeding the disposable cartridge (2) along a filling path (P); and a feed device (13) housed in a feed station (S2) along the filling path (P), and which feeds the liquid substance (3) into the disposable cartridge (2);

the unit (1) being characterized by comprising:

a coupling device (9) housed in a coupling station (S1) located along the filling path (P), upstream from the feed station (S2), and which fits the disposable cartridge (2) with a metering chamber (11), which is placed on top of the disposable cartridge (2), is of sufficient volume to contain a full measure of the liquid substance (3), and has a bottom outlet conduit (12) terminating inside the disposable cartridge (2); and a removing device (14) housed in a removal station (S4) downstream from the feed station (S2), and which removes the metering chamber (11) from the disposable cartridge (2) once all the liquid substance (3) has fallen by gravity from the metering chamber (11), along the outlet conduit (12), into the disposable cartridge (2);

and wherein the feed device (13) feeds the liquid substance (3) into the metering chamber (11), so that the liquid substance (3) falls by gravity from the metering chamber (11), along the outlet conduit (12), into the disposable cartridge (2).

* * * * *